US008960739B2

(12) United States Patent
Duff et al.

(10) Patent No.: US 8,960,739 B2
(45) Date of Patent: Feb. 24, 2015

(54) MULTI-FUNCTIONAL DOORSTOP TOOL

(76) Inventors: Robert O. Duff, Farmington, MN (US); Rosetta Duff, Farmington, MN (US)

( * ) Notice: Subject to any disclaimer, the term of this patent is extended or adjusted under 35 U.S.C. 154(b) by 275 days.

(21) Appl. No.: 13/090,408

(22) Filed: Apr. 20, 2011

(65) Prior Publication Data

US 2011/0254293 A1 Oct. 20, 2011

Related U.S. Application Data

(60) Provisional application No. 61/342,808, filed on Apr. 20, 2010.

(51) Int. Cl.
*E05C 17/54* (2006.01)
*E05C 17/00* (2006.01)

(52) U.S. Cl.
CPC ..... *E05C 17/54* (2013.01); *E05C 17/025* (2013.01); *Y10S 292/15* (2013.01)
USPC ..... 292/343; 292/DIG. 15; 16/86 A

(58) Field of Classification Search
CPC ..... E05B 2063/0039; E05C 17/00; E05C 17/047; E05C 17/54; E05C 19/007; E05C 19/18; E05C 19/182; E05C 19/184; E05C 19/188
USPC ..... 292/251.5, 288, 289, 338, 339, 342, 292/343, DIG. 15, DIG. 17, DIG. 19, 292/DIG. 63; 16/82, 83, 86 R, 86 A; 224/182; D8/402; 49/383
See application file for complete search history.

(56) References Cited

U.S. PATENT DOCUMENTS

| | | | | | |
|---|---|---|---|---|---|
| 1,119,650 | A | | 12/1914 | Smith | |
| 1,939,402 | A | | 12/1933 | Moser | |
| 3,124,382 | A | | 3/1964 | Strother | |
| 3,143,369 | A | | 8/1964 | Adams | |
| 3,328,065 | A | * | 6/1967 | Arenson | 292/343 |
| 3,473,712 | A | * | 10/1969 | Genchi | 224/234 |
| 4,424,997 | A | * | 1/1984 | Jackson | 294/53.5 |
| 4,607,253 | A | | 8/1986 | Wooten et al. | |
| 4,630,854 | A | * | 12/1986 | Persson et al. | 292/343 |
| 4,697,789 | A | * | 10/1987 | Parkins | 254/104 |
| 4,883,297 | A | | 11/1989 | Smith | |
| D331,696 | S | * | 12/1992 | Graham | D8/402 |
| 5,217,269 | A | | 6/1993 | Wiltberger | |
| D353,536 | S | * | 12/1994 | Tucker | D8/402 |
| 5,556,654 | A | * | 9/1996 | Fregeau | 426/234 |
| 5,787,548 | A | | 8/1998 | Tzen | |
| 6,085,766 | A | | 7/2000 | Geary | |
| 6,557,915 | B1 | | 5/2003 | Duff | |
| 6,581,776 | B2 | | 6/2003 | Zatkoff | |
| D481,625 | S | * | 11/2003 | Ellsworth | D8/402 |

(Continued)

FOREIGN PATENT DOCUMENTS

| | | | | |
|---|---|---|---|---|
| CH | 619753 | A5 | * | 10/1980 |
| GB | 956671 | A | * | 4/1964 |

(Continued)

*Primary Examiner* — Kristina Fulton
*Assistant Examiner* — Alyson M Merlino
(74) *Attorney, Agent, or Firm* — Kinney & Lange, P.A.

(57) ABSTRACT

A tool includes a double wedge, a tongue, and a wedge. The double wedge has a top surface, a bottom surface, a front, a rear, a right side, and a left side. The tongue extends from the front of the double wedge and the wedge extends from the rear of the double wedge. Either the tongue or the wedge can be inserted between a door and another surface to hold the door open.

14 Claims, 9 Drawing Sheets

(56) References Cited

U.S. PATENT DOCUMENTS

| | | | | |
|---|---|---|---|---|
| D517,347 | S * | 3/2006 | Hamilton et al. | D6/449 |
| 7,014,229 | B1 * | 3/2006 | Stelmach | 292/342 |
| D578,872 | S * | 10/2008 | Healy | D8/402 |
| 7,506,905 | B1 * | 3/2009 | George | 292/343 |
| D603,694 | S * | 11/2009 | Bushey | D8/402 |
| D604,156 | S * | 11/2009 | Healy | D8/402 |
| 7,976,080 | B1 * | 7/2011 | Duff | 292/343 |
| 2004/0256866 | A1 * | 12/2004 | Deming, Jr. | 292/343 |
| 2005/0212017 | A1 * | 9/2005 | Heisserer | 257/257 |
| 2007/0126248 | A1 * | 6/2007 | Mintz | 292/342 |
| 2010/0242226 | A1 * | 9/2010 | Hopkins et al. | 16/82 |

FOREIGN PATENT DOCUMENTS

| | | | |
|---|---|---|---|
| GB | 2279108 | A | 12/1994 |
| WO | WO 2006076818 | A1 * | 7/2006 |

* cited by examiner

MULTI-FUNCTIONAL DOORSTOP TOOL

CROSS-REFERENCE TO RELATED APPLICATION

This application claims priority to U.S. Provisional Patent Application No. 61/342,808 filed Apr. 20, 2010.

BACKGROUND

The present invention relates to a tool and more specifically, a doorstop tool having a multiple functions.

Doorstops are used in various professions and in everyday use for holding a door open. Most doorstops are placed under a lower edge of the door by an individual who must bend over to place the doorstop into position. The doorstop is then often kicked into position under the door to hold the door into place. Kicking the doorstop into place under the lower edge of the door causes damage to the door. However, not using a doorstop causes scratches and damage to the door by an object being forced through the doorway.

In certain professions such as maintenance, delivery and janitorial, propping a door open with the doorstop is done many times in one day. The repeated action of bending down to the floor to place the doorstop puts a stress on the individual's back. Thus, repeated use of a doorstop can lead to back injuries for the individual. Some persons, such as the elderly or handicapped are unable to bend down to place a doorstop to hold a door open and often lack other means for holding the door open.

SUMMARY

One embodiment of the present invention is a tool including a double wedge, a tongue, and a wedge. The double wedge has a top surface, a bottom surface, a front, a rear, a right side, and a left side. The tongue extends from the front of the double wedge and the wedge extends from the rear of the double wedge. Either the tongue or the wedge can be inserted between a door and another surface to hold the door open.

A second embodiment of the present invention is a tool system including a tool, a handle, and a carrying case. The tool includes a double wedge, a tongue, a wedge, and magnetic material. The double wedge has a top surface, a bottom surface, a front, a rear, a right side, and a left side. The tongue extends from the front of the double wedge and the wedge extends from the rear of the double wedge. Either the tongue or the wedge can be inserted between a door and another surface to hold the door open. The handle is capable of telescoping between an extended position and a retracted position and has a magnet for attracting the magnetic material of the tool. The carrying case includes a pocket, a cover, and a belt loop. The pocket is shaped to receive the wedge. The cover has a first end fixed to a first side of the pocket, a second end releasably securable to a second side of the pocket, and a central portion extending between the first end and the second end. The central portion has a length configured to extend over the double wedge and tongue thereby securing the wedge in the pocket. The belt loop is attached to the first side of the cover.

DETAILED DESCRIPTION

Figure 1:
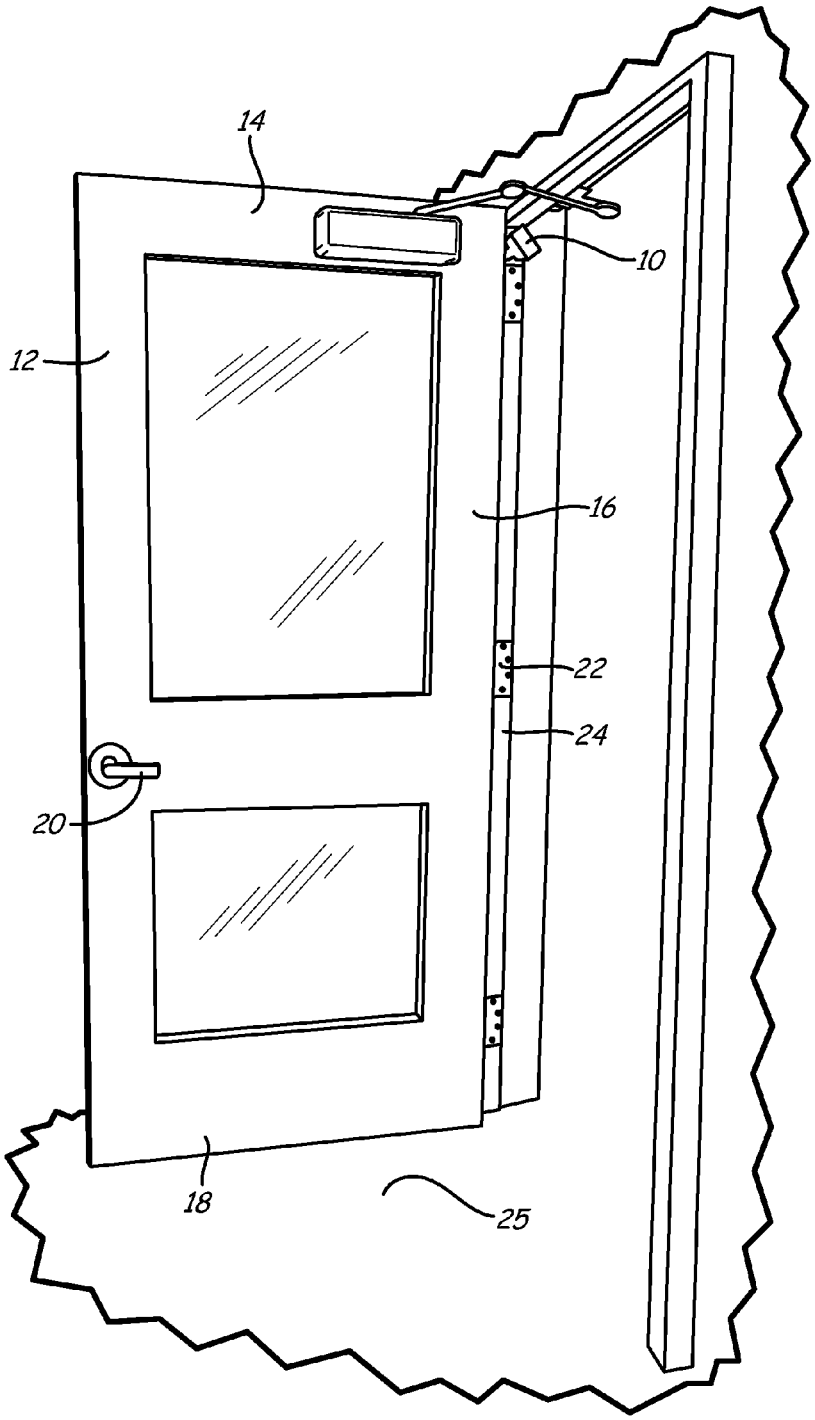
FIG. 1 is a perspective view of a tool in accordance with the present invention being used to keep a door open.

FIG. 1 is a perspective view of tool 10 being used to keep door 12 open. Door 12 includes top edge 14, side edge 16, bottom edge 18, handle 20, hinges 22, and door frame 24. Also depicted in FIG. 1 is floor 25. Tool 10 can be used as a doorstop to keep door 12 open. Door 12 is a conventional rectangular object constructed as known in the industry and placed between an inside and an outside of a building or between two rooms within a building. Top edge 14 extends along the top of door 12, side edge 16 extends along a side of door 12, and bottom edge 18 extends along a bottom of door 12. Top edge 14 is closest to a ceiling and opposite bottom edge 18 is closest to floor 25. Top edge 14 and bottom edge 18 are substantially parallel to one another, and side edge 16 forms an approximately 90 degree angle at its attachment to both top edge 14 and bottom edge 18. Handle 20 is located opposite side edge 16 of door 12 approximately halfway between top edge 14 and bottom edge 18. Handle 20 can be used to open and close door 12. Hinges 22 are attached to side edge 16 of door 12 and door frame 24 at a regular interval. Tool 10 can be inserted between top edge 14 and door frame 24, side edge 16 and door frame 24, or bottom edge 18 and floor 25 in order to keep door 12 open.

Figure 2:
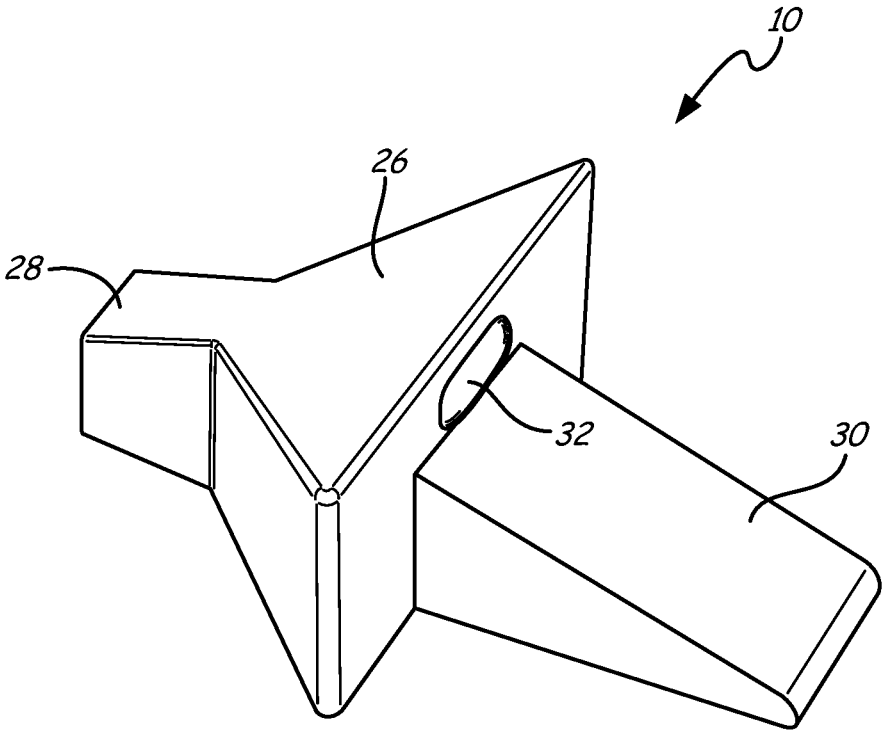
FIG. 2 is a perspective view of the tool from FIG. 1 removed from the door.

FIG. 2 is a perspective view of tool 10 from FIG. 1 removed from door 12. Tool 10 includes double wedge 26, tongue 28, wedge 30, and magnetic material 32. Either tongue 28 or wedge 30 can be inserted between door 12 and another surface to prevent relative movement therebetween. Double wedge 26 forms a center of tool 10. Attached to, and extending from, a front of double wedge 26 is tongue 28. Attached to, and extending from, a rear of double wedge 26 is wedge 30. Accordingly, tongue 28 and wedge 30 extend in opposite directions from centrally located double wedge 26. Magnetic material 32 is attached to the rear of double wedge 26 above wedge 30. Tool 10 can be formed from hardened rubber and magnetic material 32 can be formed from, for example, cobalt cemented tungsten carbide. Double wedge 26 can be used as a handle to insert tongue 28 between door 12 and another surface or, to insert wedge 30 between door 12 and another surface.

Figure 3:
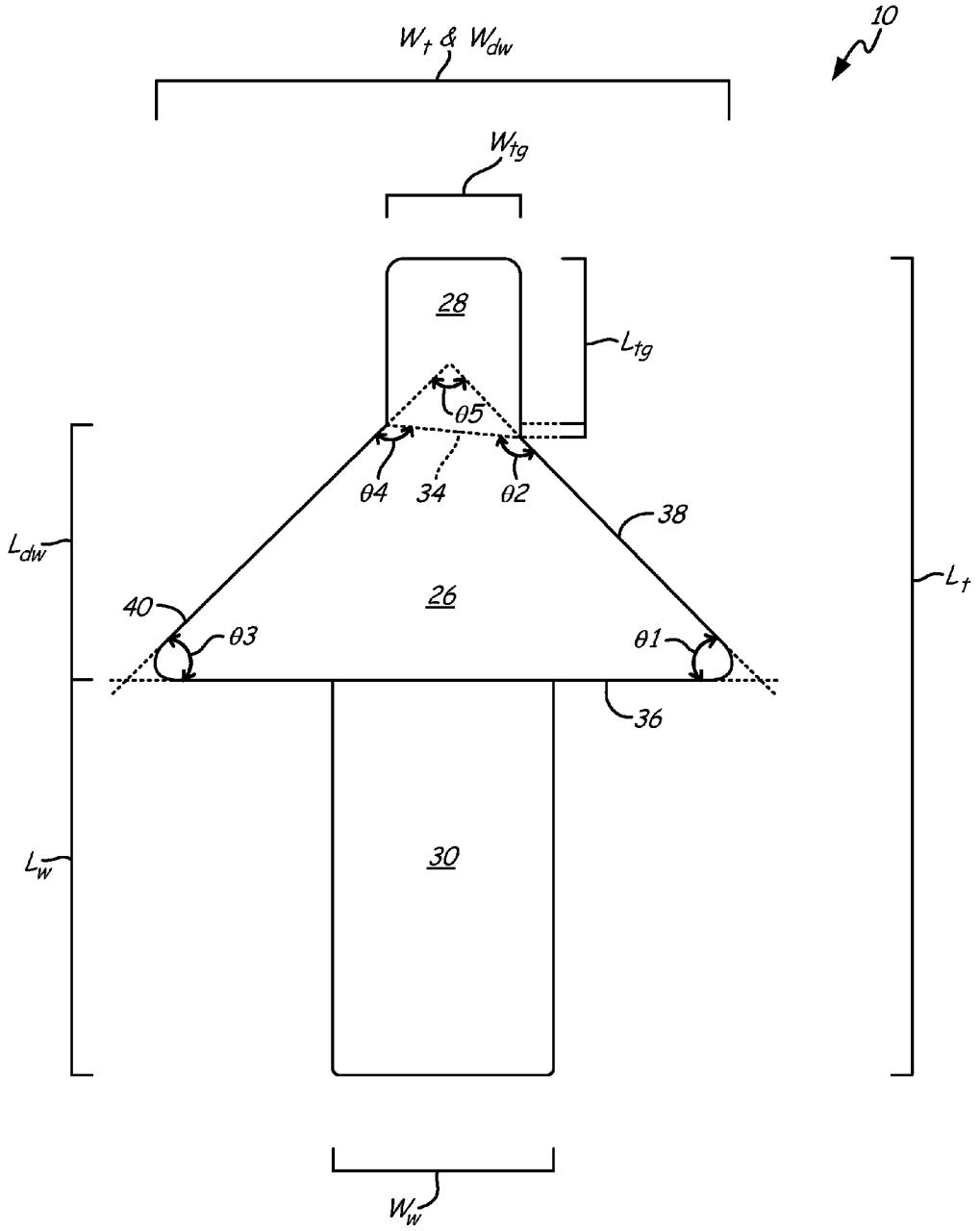
FIG. 3 is a top view of the tool.

FIG. 3 is a top view of tool 10. Depicted are parts of tool 10: double wedge 26, tongue 28, and wedge 30. Also shown are front 34, rear 36, right side 38, and left side 40 of wedge 30, as well as dimensions and angles of tool 10. Tool 10 has an overall width $W_t$ of approximately 3.8 inches (9.63 cm) and an overall length $L_t$ of approximately 5.1 inches (12.95 cm). Double wedge 26 has a width $W_{dw}$ of approximately 3.8 inches (9.63 cm; equal to $W_t$) and a length $L_{dw}$ of approximately 1.6 inches (4.06 cm). Tongue 28 has a width $W_{tg}$ of approximately 0.8 inches (2.03 cm) and a length $L_{tg}$ of approximately 1.1 inches (2.79 cm). Wedge 30 has a width $W_w$ of approximately 2.5 inches (6.35 cm) and a length $L_w$ of approximately 2.4 inches (6.1 cm).

Double wedge 26 has right side 38 forming acute angle θ1 of approximately 44° with rear 36 and forming obtuse angle θ2 of approximately 140° with front 34. Similarly, left side 40 forms acute angle θ3 of approximately 46° with rear 36 and forms obtuse angle θ4 of approximately 130° with front 34. If a line of right side 38 is continued to intersect a line of left side 40, then angle θ5 of approximately 90° is formed. Right side 38 attaches to the rear of tongue 28 approximately 0.125 inches (3.18 mm) ahead of where left side 38 attaches to the rear of tongue 28. Accordingly, obtuse angle θ2 and obtuse angle θ4 are offset from one another and front 34 of double wedge 34 is slanted. The resulting difference in slopes between right side 38 and left side 40 provides a more secure stopping function for tool 10 when tongue 28 is inserted between door 12 and another surface.

Figure 4:
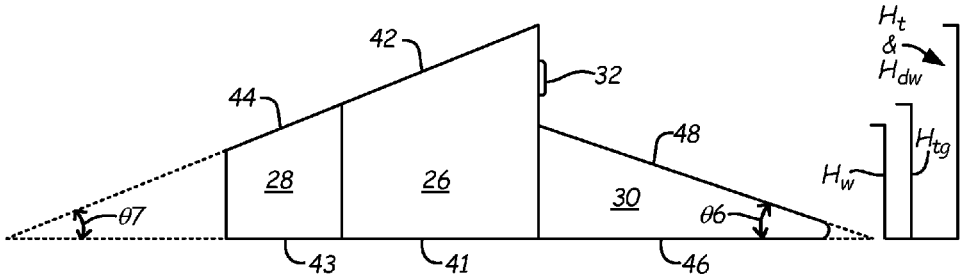
FIG. 4 is a side view of the tool.

FIG. 4 is a side view of tool 10. Depicted are parts of tool 10: double wedge 26, tongue 28, wedge 30, and magnetic material 32. Also shown are bottom surface 41 and top surface 42 of double wedge 26, bottom surface 43 and top surface 44 of tongue 28, bottom surface 46 and top surface 48 surface of wedge 30, and various angles and dimensions of tool 10 components. Tool 10 has an overall height $H_t$ of approximately 1.75 inches (4.45 cm). Double wedge 26 has an overall height $H_{dw}$ of approximately 1.75 inches (4.45 cm), the same as $H_t$. Tongue 28 has a height $H_{tg}$ of approximately 1.2 (3.05 cm). Wedge 30 has a height $H_w$ of approximately 0.9 inches (2.30 cm). Height $H_{tg}$ and width $W_{tg}$ of tongue 28 are not equal values and allow for tongue 28 to be used in two directions with different results.

Bottom surfaces 41, 43, and 46 of double wedge 26, tongue 28, and wedge 46, respectively, are flat, continuous, and coplanar. Top surfaces 42 and 44 of double wedge 26 and tongue 28, respectively, are ramped in a first direction, continuous, and coplanar. Top surface 48 of wedge 30 is ramped in a second direction, which is opposite the first direction. Bottom surface 46 and top surface 48 of wedge 30 intersect to form acute angle θ6 of approximately 19° at a rear of wedge 30. Top surface 48 extends from acute angle θ6 toward a front of wedge 30, which is attached to the rear of double wedge 26. If a line extending through top surface 44 of tongue 28 is extended to intersect a line extending through bottom surface 43 of tongue 28, an acute angle θ7 of approximately 25° is formed. The geometry of tool 10 is configured to provide multiple stopping functions within a single tool 10.

Figure 5:
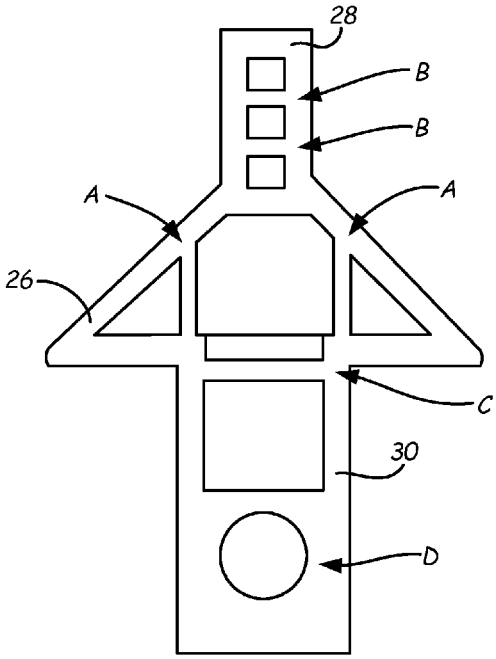
FIG. 5 is a bottom view of the tool.

FIG. 5 is a bottom view of tool 10. Depicted are parts of tool 10: double wedge 26, tongue 28, and wedge 30. Also shown are locations A, B, C, and D. As can be seen from the bottom view, tool 10 is substantially hollow and has a perimeter of material equal to approximately 0.5 inches (1.27 cm). Locations A extend downwardly on both right side 38 and left side 40 of double wedge 26 from positions at a top of double wedge 26 (near tongue 28) and to positions at a bottom of double wedge 26 (near wedge 30). Locations B extend across a center of tongue 28 from a right side to a left side. Location C extends across a center of wedge 30 from a right side to a left side at a position near double wedge 26. Location D is opposite location C (far from double wedge 26) and includes a circular cut out. Locations A, B, C, and D can be reinforced by the addition of a cross-bar into the substantially hollow tool 10. In one embodiment, the cross-bars are formed from the same hardened rubber as the rest of tool 10. An alternative to positioning a cross-bar in location B, is completely filling tongue 28 such that it is no longer hollow. In one embodiment, the filling is formed from the same hardened rubber as the rest of tool 10. In the depicted embodiment, location D is filled in, but then a circular cut-out is formed. While it is desirable to have tool 10 deform slightly during use, reinforcements at locations A, B, C, & D may decrease wear and tear of tool 10.

Figure 6:
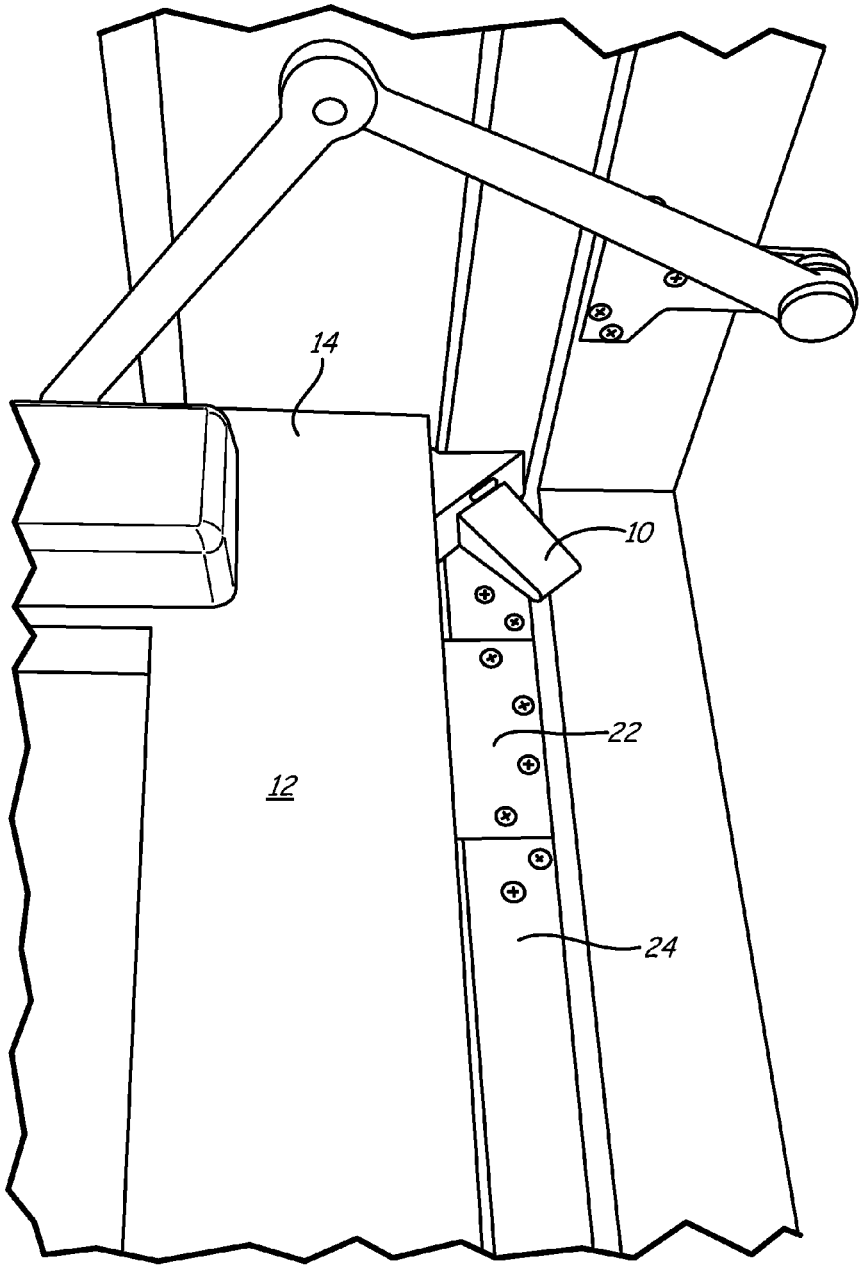
FIG. 6 is a perspective view of the tool inserted between a top edge of the door and a door frame.

FIG. 6 is a perspective view of tool 10 inserted between top edge 14 of door 12 and door frame 24 adjacent hinges 22. More specifically, wedge 30 is used as a handle to insert tongue 28 between top edge 14 and door frame 24 to keep door 12 open. Depending on the amount of space between top edge 14 of door 12 and door frame 24, tongue 28 is inserted either height-wise $H_{tg}$ or width-wise $W_{tg}$. When tongue 28 is positioned properly, side edge 16 of door 12 and door frame 24 will be at an approximately 90 degree angle and hinges 22 will be relieved from strain.

Figure 7:
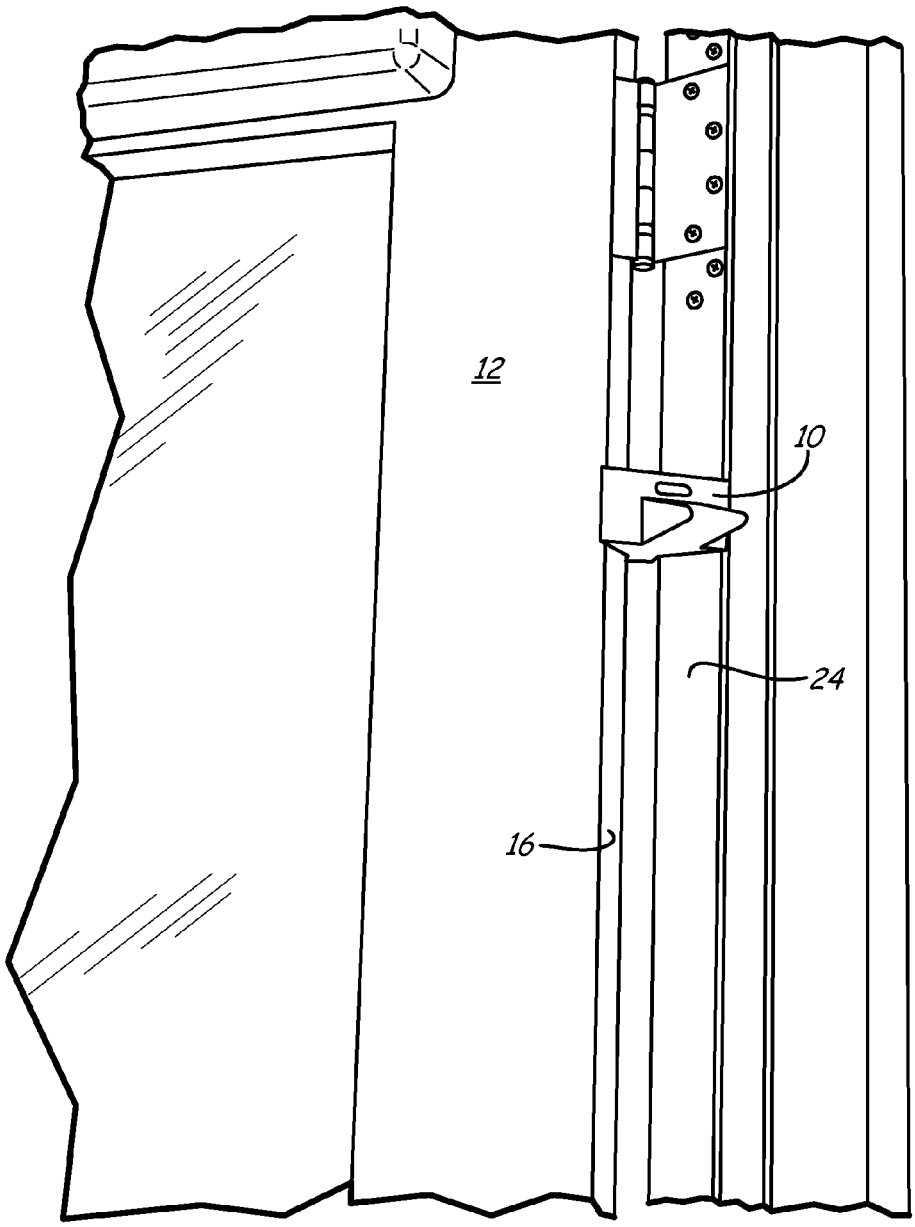
FIG. 7 is a perspective view of the tool inserted between a side edge of the door and the door frame.

FIG. 7 is a perspective view of tool 10 inserted between side edge 16 of door 12 and door frame 24. More specifically, wedge 30 is used as a handle to insert tongue 28 between side edge 16 and door frame 24 to keep door 12 open. Depending on the amount of space between side edge 16 of door 12 and door frame 24, tongue 28 is inserted either height-wise $H_{tg}$ or width-wise $W_{tg}$ to form a desired angle between side edge 16 and door frame 24.

Figure 8:
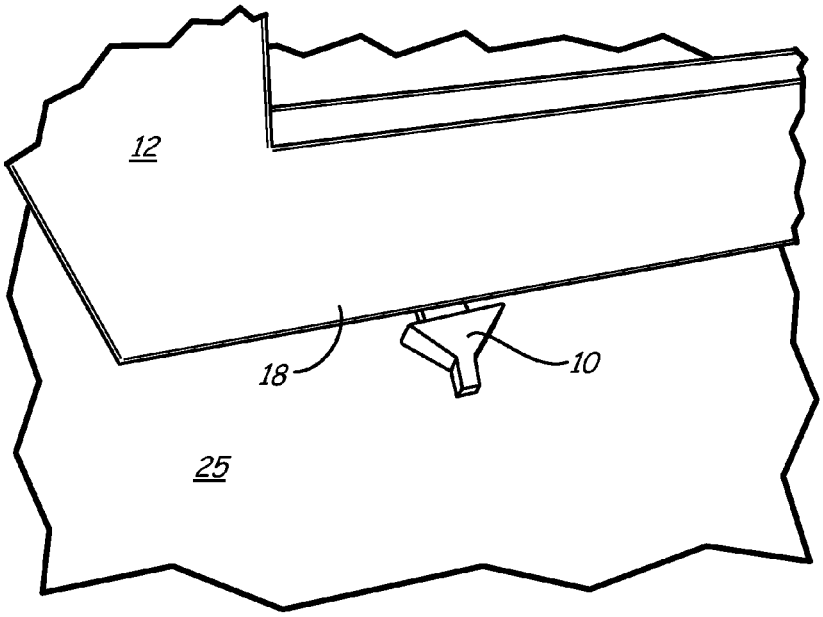
FIG. 8 is a perspective view of the tool inserted between a bottom edge of the door and a floor.

FIG. 8 is a perspective view of tool 10 inserted between bottom edge 18 of door 12 and floor 25. More specifically, tongue 28 is used as a handle to insert wedge 30 between bottom edge 18 and floor 25 to keep door 12 open. If the amount of space between bottom edge 18 of door 12 and floor 25 is great, the tool can be rotated 90° such that tongue 28 is inserted beneath bottom edge 18 of door 12 and floor 25.

Figure 9:
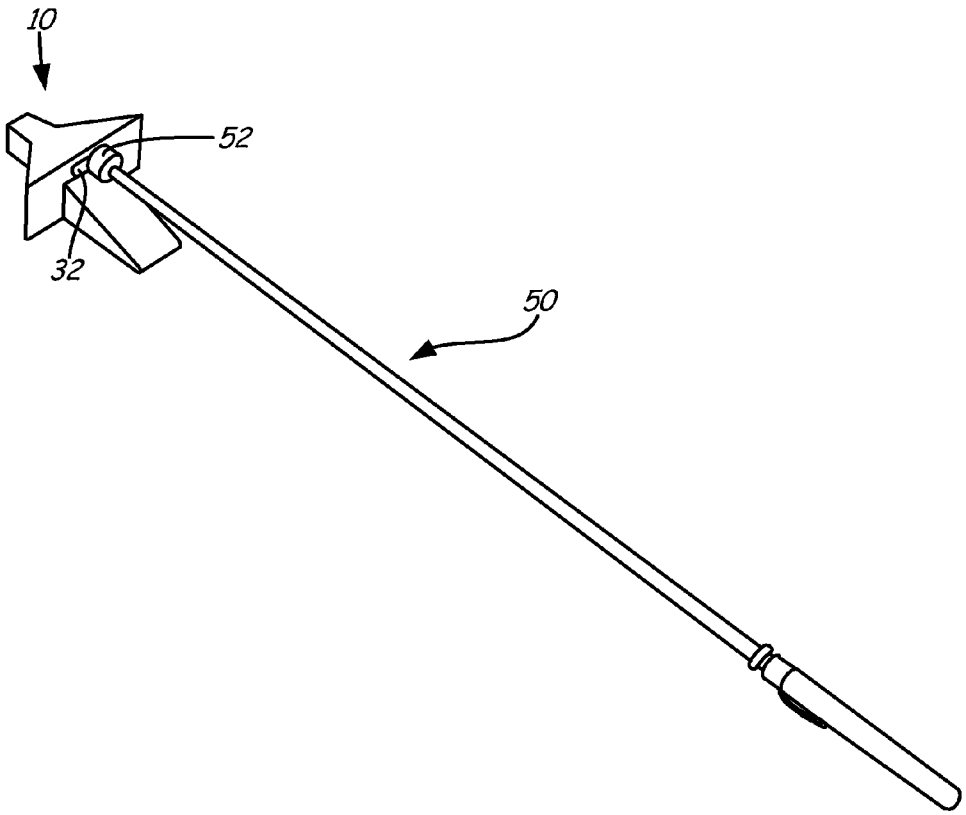
FIG. 9 is a perspective view of a handle attached to the tool.

FIG. 9 is a perspective view of tool 10 and handle 50, which form a system for picking up tool 10. Also shown are magnetic material 32 located on tool 10 and magnet 52 located on handle 50. Handle 50 can be used to pick up tool 10 such that a user of tool 10 need not bend over to retrieve tool 10 from floor 25. If magnet 52 is positioned near magnetic material 32, magnetic forces will form a magnetic coupling between handle 50 and tool 10. Handle 50 telescopes between a compact position (depicted in FIG. 12) for transport and an extended position (depicted in FIG. 9) for use. Handle 50 and the magnetic coupling between magnet 52 and magnetic material 32 are described in detail in co-pending U.S. patent application Ser. No. 12/080,920 filed Apr. 7, 2008 and titled Doorstop with Releasably Securable Handle 50, which is hereby incorporated by reference.

Figure 10:
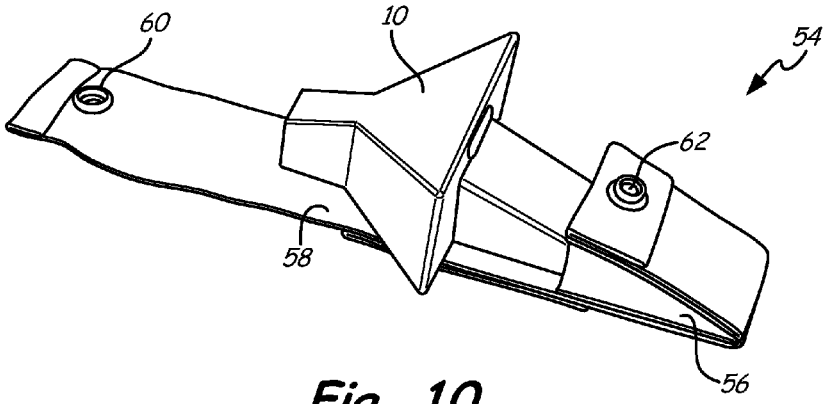
FIG. 10 is a perspective view of the tool being inserted into a case.

FIG. 10 is a perspective view of tool 10 and case 54, which form a system for transporting tool 10. Also shown are parts of case 54: pocket 56, cover 58, female snap 60, and male snap 62. Pocket 56 has a triangular configuration and is shaped to receive wedge 30 of tool 10. Cover 58 has a first end fixed to a first side of pocket 56, a second end that carries female snap 60, and a central portion extending between the first and second ends. When wedge 30 is inserted into pocket 56, the central portion of cover 58 has a predetermined length (approximately 7.9 inches or 20.07 cm) configured to extend over double wedge 26 and tongue 28 thereby securing the wedge 30 in pocket 56. Female snap 60 is releasably attachable to male snap 62, which is located on the second side of pocket 56 opposite the first end of cover 58. When female snap 60 is attached to male snap 62, tool 10 is secured within case 54. Other means of releasable attachment between pocket 56 and cover 58 are equally possible, such as magnets or hook and loop fasters.

Figure 11:
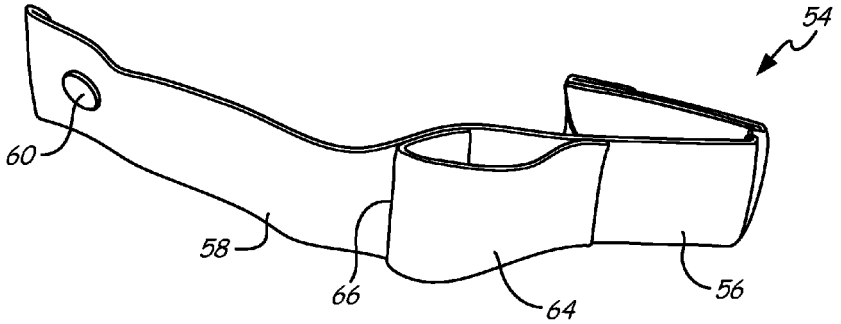
FIG. 11 is a perspective view of the case from FIG. 10 with the tool removed.

FIG. 11 is a perspective view of case 54 from FIG. 10 with tool 10 removed. Also shown are parts of case 54: pocket 56, cover 58, female snap 60, belt loop 64, and slot 66. In the depicted embodiment, case 54 is formed from nylon. Belt loop 54 is located on a back side of cover 58 near first end where cover 58 is attached to pocket 56. Belt loop 54 extends from a location near the first end of cover 58 along central portion of cover 58 before doubling back toward the first end of cover 58. Accordingly, belt loop 54 forms an open loop for securing case 54 to a user's belt. Located between cover 58 and belt loop 65 is slot 66. Slot 66 extends downwardly from the central portion of cover 58 toward pocket 56. Slot 66 has an open front and a closed rear such that slot 66 can retain an object. Slot 66 is dimensioned with width of approximately 2 inches (5.08 cm) and a depth of approximately 5 inches (12.7 cm) to receive and secure handle 50 within case 54 (shown in FIG. 12).

Figure 12:
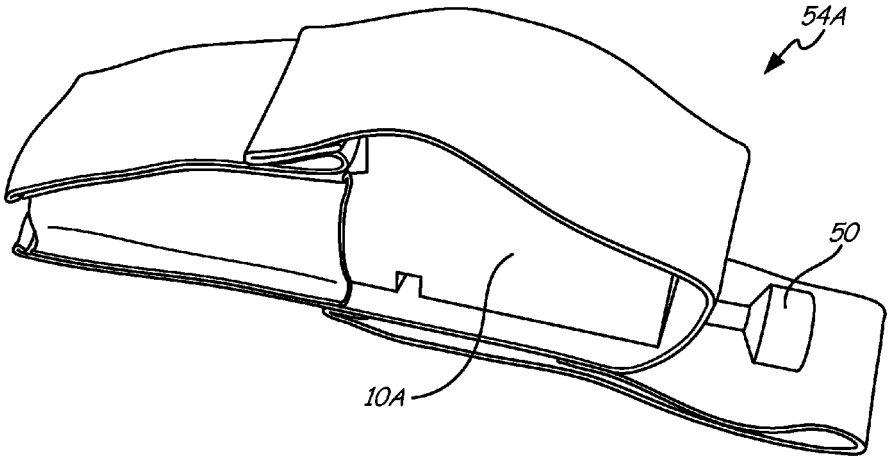
FIG. 12 is a perspective view of another embodiment of the tool secured within a case.

FIG. 12 is a perspective view of an alternative embodiment of tool 10A and handle 50 inserted into case 54A. Tool 10A is similar to tool 10 described above, in that tool includes a wedge portion. Case 54A is similar to case 54 described above in that case 54A includes a pocket shaped to receive wedge, a cover extending over tool 10 that is releasably securable to the pocket, a belt loop and a slot. Inserted into the slot of case 54A is handle 50. As shown, case 54A provides an easy means for carrying both tool 54A and handle 50 on a user's belt.

Although the present invention has been described with reference to preferred embodiments, workers skilled in the art will recognize that changes may be made in form and detail without departing from the spirit and scope of the invention.

The invention claimed is:

1. A tool comprising:

a double wedge having a top surface, a bottom surface, a front, a rear, a right side, and a left side;

a tongue extending forward from the front of the double wedge, the tongue having a top surface, a bottom surface, a rear attached to the front of the double wedge, and a front spaced from and forward of the front of the double wedge;

a wedge extending rearward from the rear of the double wedge, the wedge having a top surface, a bottom surface, a front attached to the rear of the double wedge and a rear that is spaced from and rearward of the rear of the double wedge;

wherein the right side and left side of the double wedge converge as they extend from the rear to the front of the double wedge;

wherein the bottom surfaces of the double wedge, the tongue and the wedge are flat, continuous, and coplanar;

wherein the top surfaces of the double wedge and the tongue are continuous, coplanar, and inclined upward at a first angle such that the inclination of the top surfaces of the double wedge and the tongue extend upwards from the front of the tongue towards the rear of the double wedge;

wherein the top surface of the wedge is inclined upward at a second angle such that the inclination of the top surface of the wedge extends upwardly from the rear of the wedge towards the front of the wedge, wherein the second angle is different than the first angle; and wherein the double wedge has a width ($W_{dw}$) at the rear of the double wedge that is greater than a width ($W_w$) of the wedge and greater than a width ($W_{tg}$) of the tongue;

wherein the double wedge has a height $H_{dw}$ at the rear of the double wedge that is greater than a height ($H_w$) of the wedge adjacent the rear of the double wedge; and wherein the wedge has a length ($L_w$) that is greater than a length ($L_{dw}$) of the double wedge and greater than a length ($L_{tg}$) of the tongue; and wherein either the tongue or the wedge can be inserted between a door and another surface to hold the door open.

2. The tool of claim 1, wherein the double wedge, the tongue, and wedge are formed from hardened rubber material.

3. The tool of claim 1, wherein the right side and the rear of the double wedge form a third angle, and the left side and the rear of the double wedge form a fourth angle, the third angle and the fourth angle being different angles.

4. The tool of claim 1, wherein the wedge is insertable between a bottom edge of the door and a floor to stop relative movement therebetween.

5. The tool of claim 4, wherein the double wedge is insertable between a side edge of the door and a door frame to stop relative movement therebetween.

6. The tool of claim 5, wherein the double wedge is insertable between a top edge of the door and the door frame to stop relative movement therebetween.

7. The tool of claim 6, further comprising:

magnetic material located on the rear of the double wedge.

8. The tool of claim 7, further comprising:

a telescoping handle having a magnet for attracting the magnetic material on the double wedge, wherein a user can pick up the double wedge with the handle.

9. The tool of claim 1, furthering comprising:

a carrying case comprising:

a pocket shaped to receive the wedge;

a cover having a first end fixed to a first side of the pocket, a second end releasably securable to a second side of the pocket, and a central portion extending between the first end and the second end, wherein the central portion has a length configured to extend over the double wedge and tongue thereby securing the wedge in the pocket; and a belt loop attached to a first side of the cover.

10. A tool system comprising:

a tool comprising:

a double wedge having a top surface, a bottom surface, front, a rear, a right side, and a left side;

a tongue extending forward from the front of the double wedge, the tongue having a top surface, a bottom surface, a rear attached to the front of the double wedge, and a front spaced from and forward of the front of the double wedge;

a wedge extending rearward from the rear of the double wedge, the wedge having a top surface a bottom surface, a front attached to the rear of the double wedge and a rear that is spaced from and rearward of the rear of the double wedge;

wherein the right side and left side of the double wedge converge as they extend from the rear to the front of the double wedge;

wherein the bottom surfaces of the double wedge, the tongue and the wedge are flat, continuous, and coplanar;

wherein the top surfaces of the double wedge and the tongue are continuous, coplanar, and inclined upward at a first angle such that the inclination of the top surfaces of the double wedge at the tongue extend from the front of the tongue towards the rear of the double wedge;

wherein the top surface of the wedge is inclined upward at a second angle such that the inclination of the top surface of the wedge extends from the rear of the wedge towards the front of the wedge, wherein the second angle is different than the first angle;

wherein the double wedge has a width ($W_{dw}$) at the rear of the double wedge that is greater than a width ($W_w$) of the wedge and greater than a width ($W_{tg}$) of the tongue;

wherein the double wedge has a height ($H_{dw}$) at the rear of the double wedge that is greater than a height ($H_w$) of the wedge adjacent the rear of the double wedge;

wherein the wedge has a length ($L_w$) that is greater than a length ($L_{dw}$) of the double wedge and greater than a length ($L_{tg}$) of the tongue; and wherein either the tongue or the wedge can be inserted between a door and another surface to hold the door open; and magnetic material located on the rear of the double wedge;

a handle capable of telescoping between an extended position and a retracted position, the handle having a magnet for attracting the magnetic material of the tool; and a carrying case comprising:

a pocket shaped to receive the wedge;

a cover having a first end fixed to a first end of the pocket, a second end releasably securable to a second side of the pocket, and a central portion extending between the first end and the second end, wherein the central portion has a length configured to extend over the double wedge and tongue thereby securing the wedge in the pocket; and a belt loop attached to the first end of the pocket and a first side of the cover.

11. The tool system of claim 10, wherein the wedge is insertable between a bottom edge of the door and a floor to stop relative movement therebetween.

12. The tool system of claim 11, wherein the double wedge is insertable between a side edge of the door and a door frame to stop relative movement therebetween.

13. The tool system of claim 12, wherein the double wedge is insertable between a top edge of the door and the door frame to stop relative movement therebetween.

14. The tool system of claim 10, wherein the magnetic material contains tungsten.

* * * * *